US008119239B2

(12) United States Patent
Inbe et al.

(10) Patent No.: US 8,119,239 B2
(45) Date of Patent: Feb. 21, 2012

(54) SURFACE-CONDITIONING COMPOSITION COMPRISING METAL PHOSPHATE PARTICLES, METAL ALKOXIDE AND STABILIZER, AND METHOD OF PRODUCTION THEREOF

(75) Inventors: Toshio Inbe, Tokyo (JP); Masahiko Matsukawa, Tokyo (JP); Kotaro Kikuchi, Tokyo (JP)

(73) Assignee: Nippon Paint Co., Ltd., Osaka (JP)

( * ) Notice: Subject to any disclaimer, the term of this patent is extended or adjusted under 35 U.S.C. 154(b) by 278 days.

(21) Appl. No.: 11/990,559

(22) PCT Filed: Aug. 21, 2006

(86) PCT No.: PCT/JP2006/316344

§ 371 (c)(1), (2), (4) Date: Feb. 14, 2008

(87) PCT Pub. No.: WO2007/021025

PCT Pub. Date: Feb. 22, 2007

(65) Prior Publication Data

US 2009/0035577 A1 Feb. 5, 2009

(30) Foreign Application Priority Data

Aug. 19, 2005 (JP) ..... 2005-239235

(51) Int. Cl.
*B32B 5/16* (2006.01)

(52) U.S. Cl. ..... 428/403; 106/14.41; 106/14.05; 106/14.44; 148/254; 428/402; 428/407

(58) Field of Classification Search ..... 428/402–407; 148/254; 106/14.41, 14.05, 14.12, 14.44
See application file for complete search history.

(56) References Cited

U.S. PATENT DOCUMENTS

| | | | | |
|---|---|---|---|---|
| 7,722,710 | B2 * | 5/2010 | Inbe et al. | 106/14.41 |
| 7,749,319 | B2 * | 7/2010 | Inbe et al. | 106/401 |
| 2004/0011429 | A1 * | 1/2004 | Miyamoto et al. | 148/254 |
| 2005/0245633 | A1 * | 11/2005 | Soutar et al. | 522/83 |
| 2006/0127681 | A1 * | 6/2006 | Domes et al. | 428/447 |
| 2007/0240604 | A1 * | 10/2007 | Inbe et al. | 106/1.12 |
| 2009/0192251 | A1 * | 7/2009 | Chung et al. | 524/417 |

FOREIGN PATENT DOCUMENTS

| | | | |
|---|---|---|---|
| JP | 59-226181 | | 12/1984 |
| JP | 10-245685 | | 9/1998 |
| JP | 2000-096256 | | 4/2000 |
| JP | 2004-068149 | | 3/2004 |
| JP | 2007/077500 | * | 3/2007 |

* cited by examiner

*Primary Examiner* — Hoa (Holly) Le
*Assistant Examiner* — Ronak Patel
(74) *Attorney, Agent, or Firm* — Dilworth & Barrese, LLP.

(57) ABSTRACT

A surface-conditioning composition includes a particle of a phosphate of a bivalent or trivalent metal and has a pH value ranging from 3 to 12. The particle has a $D_{50}$ value of 3 μm or less. The composition additionally includes (1) at least one metal alkoxide selected from a silane alkoxide, a titanium alkoxide and an aluminum alkoxide and (2) a stabilizing agent.

17 Claims, 1 Drawing Sheet

SURFACE-CONDITIONING COMPOSITION COMPRISING METAL PHOSPHATE PARTICLES, METAL ALKOXIDE AND STABILIZER, AND METHOD OF PRODUCTION THEREOF

TECHNICAL FIELD

The present invention relates to a surface conditioning composition, and a surface conditioning method.

BACKGROUND ART

Automotive bodies, home electrical appliances and the like have been manufactured in which metal materials such as steel sheets, galvanized steel sheets, and aluminum-based metal materials are made into a molded metal form, and thereafter painting, assembly and the like are performed. The painting of such a molded metal form is performed through various processes such as degreasing, surface conditioning, chemical conversion treatment, and electrodeposition coating.

The surface conditioning is performed for the subsequent chemical conversion treatment, in which a chemical conversion coating film made of phosphate crystals is formed on the entire surface of the metal material uniformly, quickly and with high density. Generally, in surface conditioning, phosphate nuclei are formed on the surface of a metal material by dipping into a treatment liquid for surface conditioning. As a treatment liquid used for such a surface conditioning treatment, a composition is known in which bivalent or trivalent metal phosphate is combined with various stabilizers (e.g., Patent Document 1, Patent Document 2 and Patent Document 3).

Patent Document 1 discloses a pretreatment liquid for surface conditioning used before the chemical conversion treatment of a metal, which has a pH adjusted to be 4 to 13, and which includes: at least one selected from phosphate including at least one kind of bivalent or trivalent metals including a particle of a diameter of no more than 5 μm; an alkali metal salt, an ammonium salt or a mixture thereof; and at least one selected from the group consisting of an anionicly charged and dispersed oxidant fine particle, anionic water-soluble organic polymer, nonionic water-soluble organic polymer, anionic surfactant, and nonionic surfactant.

Patent Document 2 discloses a treatment liquid for surface conditioning before a chemical conversion treatment, which contains at least one kind of phosphate particle selected from phosphate containing at least one of bivalent and/or trivalent metals, and which further contains at least one kind selected from monosaccharide, polysaccharide and a derivative thereof; orthophosphoric acid and polyphosphoric acid or an organic phosphon acid compound and at least one kind of water-soluble polymer compound consisting of a polymer or a derivative of vinyl acetate, or a copolymer of monomer, which is copolymerizable with vinyl acetate, and vinyl acetate; or a polymer or copolymer resulting from polymerization of: at least one kind selected from a particular monomer or a, β unsaturated carboxylic acid monomer, and no more than 50 mass % of a monomer which is copolymerizable with the monomer. Moreover, Patent Document 3 discloses a surface conditioning composition in which clay mineral is used together with phosphate.

However, even the treatment liquids for surface conditioning disclosed in these documents may not have sufficient chemical conversion properties. For example, in the portion where aluminum-based metal materials come in contact with steel sheets or galvanized steel sheets, the aluminum-based metal materials become an anode, and the steel sheets or galvanized steel sheets become a cathode, and therefore electrochemical corrosion reactions (electrolytic corrosion) tend to occur due to the potential difference of the different kinds of metal. This leads to a problem in that it is difficult to form a conversion coating film on the surface of the aluminum-based metal materials. Due to this, a surface conditioning composition, which can suppress electrolytic corrosion of the metal materials in a conversion treatment, is intended to be developed.

In addition, when these treatment liquids for surface conditioning are applied to conversion resistant metal materials such as aluminum-based metal materials and high-tensile steel sheets, there is a problem in that a sufficient amount of conversion coating film is not formed on the surface of the metal materials. In addition, the required level of corrosion resistance has been increased in recent years, and the formation of a more dense conversion coating film has been desired. Moreover, regarding these treatment liquids for surface conditioning, the particle size of the phosphate particles is large, and the specific surface area is small, and there has been a problem in that phosphate particles in the conversion treatment bath tend to sediment. Due to this, a surface conditioning composition which solves these problems and which has further superior properties has been desired.

Patent Document 1: Japanese Unexamined Patent Application, Publication No. H 10-245685

Patent Document 2: Japanese Unexamined Patent Application, Publication No. 2000-96256

Patent Document 3: Japanese Unexamined Patent Application, Publication No. S 59-226181

DISCLOSURE OF THE INVENTION

Problems to be Solved by the Invention

In view of the aforementioned problems, an object of the present invention is to provide a surface conditioning composition, which can result in higher chemical conversion performance in the chemical conversion treatment reaction as compared to that conventionally, can form a dense phosphate crystal coating film, can suppress electrolytic corrosion of the metal materials during the conversion treatment, can form a sufficient amount of conversion coating film even when applied to conversion resistant metal materials such as aluminum alloy and high-tensile steel sheets, can shorten the time required for the conversion treatment by improving the chemical conversion properties, and has superior long-term dispersion stability in the treatment liquid.

Means for Solving the Problems

A surface conditioning composition including a bivalent or trivalent metal phosphate particles and having a pH of 3 to 12, wherein a $D_{50}$ of the bivalent or trivalent metal phosphate particles is no more than 3 μm, and the surface conditioning composition includes (1) at least one metal alkoxide selected from the group consisting of silane alkoxide, titanium alkoxide, and aluminum alkoxide and (2) a stabilizer.

The aforementioned bivalent or trivalent metal phosphate particle is preferably zinc phosphate.

The aforementioned (1) metal alkoxide as described above is preferably an alkoxysilane compound having at least one group selected from the group consisting of mercapto group and (meth)acryloxy group.

When the composition for surface conditioning of the present invention is the treatment liquid for surface conditioning, it is preferred that the content of the metal alkoxide be preferably 1 to 1000 ppm.

The aforementioned (2) stabilizer is preferably at least one selected from the group consisting of phosphonic acid, phytic acid, polyphosphoric acid, phosphonic acid group-containing acrylic resin and vinylic resin, carboxyl group-containing acrylic resin and vinylic resin, saccharide, and layered clay mineral.

The method for surface conditioning of the present invention includes a step of bringing the treatment liquid for surface conditioning in contact with a metal material surface.

The term "surface conditioning composition" referred to herein indicates to include both a "treatment liquid for surface conditioning" that is a treatment liquid for bringing into contact with the metal material actually in the surface conditioning treatment, and a "concentrated dispersion liquid" that is a dispersion liquid of the metal phosphate particles used for producing the treatment liquid for surface conditioning through dilution. The treatment liquid for surface conditioning is obtained by diluting the concentrated dispersion liquid with a solvent such as water to give a predetermined concentration, and adding the necessary additives followed by adjusting the pH.

Furthermore, in cases where the surface conditioning composition of the present invention is used, the surface conditioning treatment is carried out after subjecting the metal material to a required pretreatment, and then a conversion treatment is carried out. In other words, the term "surface conditioning treatment" referred to herein indicates a first phosphate treatment, which is a step for allowing metal phosphate particles to adhere on a metal material surface. In addition, the term "chemical conversion treatment" indicates a second phosphate treatment subsequent to the surface conditioning treatment, which is a treatment for allowing the phosphate particles adhered on the metal material surface by the surface conditioning treatment to grow in the form of crystals. Moreover, the coating film of the metal phosphate formed by the surface conditioning treatment is herein referred to as a "phosphate coating film", while the coating film of metal phosphate particles formed by the chemical conversion treatment is referred to as a "chemical conversion coating film".

The present invention is explained below in detail.

[Composition for Metal Surface Conditioning]

The composition for surface conditioning of the present invention further contains (1) at least one metal alkoxide selected from the group consisting of silane alkoxide, titanium alkoxide, and aluminum alkoxide in addition to bivalent or trivalent metal phosphate particles and (2) a stabilizer. This improves the function of the surface conditioning composition and imparts superior properties to the surface conditioning composition. It should be noted that the composition for surface conditioning of the present invention may be a treatment liquid for surface conditioning, or may be a concentrated dispersion liquid.

The composition for surface conditioning of the present invention contains: (1) at least one metal alkoxide selected from the group consisting of silane alkoxide, titanium alkoxide, and aluminum alkoxide; bivalent or trivalent metal phosphate particles with the $D_{50}$ of no more than 3 μm; and (2) a stabilizer.

As compared to conventionally known surface conditioning compositions, the surface conditioning composition of the present invention has superior dispersion stability in a treatment liquid for surface conditioning, is able to suppress electrolytic corrosion of metal materials during the chemical conversion treatment, and is able to form a sufficient amount of chemical conversion coating film even in a case of being applied to conversion resistant metal materials such as aluminum-based metal materials and high-tensile steel sheets.

The surface conditioning composition containing the (1) metal alkoxide is very easily adsorbed to zinc phosphate particles, and therefore is speculated to have superior chemical conversion performance.

In cases where the surface conditioning composition including conventionally known phosphate particles of bivalent or trivalent metal is applied to conversion resistant metal materials such as aluminum-based metal materials and high-tensile steel sheets, there have been know problems in that a sufficient amount of chemical conversion coating film is not formed in a chemical conversion treatment subsequent to surface conditioning treatment, and that sufficient corrosion resistance is difficult to be imparted to such metal materials.

In cases where the surface conditioning composition of the present invention is used, it is possible to form a sufficient amount of coating film in a chemical conversion treatment and, even to conversion resistant metal materials such as aluminum-based metal materials and high-tensile steel sheets, and to impart sufficient corrosion resistance to these materials.

Moreover, in cases where the treatment liquid for surface conditioning of the present invention is applied to metal materials such as cold-rolled steel sheets and galvanized steel sheets, for which satisfactory corrosion resistance can be obtained with a conventional surface conditioning composition, it is possible to further increase the density of a chemical conversion coating film formed on the metal materials, thereby further improving the corrosion resistance.

In addition, according to the surface conditioning composition, in-cases where iron- or zinc-based metal materials and aluminum-based metal materials are used in combination, and there is a portion in which the iron- or zinc-based metal materials and the aluminum-based metal materials contact with each other, i.e. even in cases where the surface conditioning composition is applied to a portion where the different kinds of metals contact with each other, it is possible to form a sufficient amount of chemical conversion coating film in the subsequent chemical conversion treatment.

In cases where an ordinary chemical conversion treatment is performed to the portion where the different kinds of metals contact with each other, the aluminum-based metal material portion becomes an anode and the iron- or zinc-based metal material portion becomes a cathode at the portion where the different kinds of metals contact with each other. As a result, it is difficult for a sufficient amount of chemical conversion coating film to be formed at the aluminum-based metal material portion where the different kinds of metals contact with each other.

On the other hand, according to the surface conditioning composition of the present invention, it is speculated that the chemical conversion treatment performance is improved by the increased amount of the metal phosphate particles to be adhered to a metal material surface. As a result, as compared to cases where the conventional surface conditioning composition is used, it is speculated to be possible to suppress electrolytic corrosion at the aluminum-based metal material portion where the different kinds of metals contact with each other.

Due to this, for example, if the surface conditioning is performed with the surface conditioning composition of the present invention to metal materials having a portion where iron- or zinc-based metal materials and aluminum-based metal materials contact with each other, and subsequently a chemical conversion treatment is performed, it is possible to form a sufficient amount of chemical conversion coating film on the aluminum-based metal material portion where the different kinds of metals contact with each other. Moreover, it is possible to form a sufficient amount of chemical conversion coating film on the surface of the conversion resistant metal materials.

[Metal Alkoxide]

In the present invention, it has been found that an effect of adding (2) stabilizer is further improved by using the (1) metal alkoxide in combination with the (2) stabilizer to be described later.

That is to say, by including the (1) metal alkoxide, the following effects of adding the stabilizer are accelerated, respectively: stabilization of the dispersion state in the solvent of the metal phosphate particles; improvement of ability of metal phosphate particles to adhere to a surface of metal materials; and formation of a sufficient amount of chemical conversion coating film on a surface of metal materials at the time of a chemical conversion treatment.

Though it is not clear why the effects of adding the (2) stabilizer are further improved, it is speculated as follows. The (1) metal alkoxide produces a hydroxyl group by hydrolysis of an alkoxy group in a solution, the resulting hydroxyl group is absorbed to the surfaces of metal phosphate particles through interactions such as hydrogen bonding, thereby suppressing reaggregation of the metal phosphate particles. As a result, dispersion stability is improved, metal phosphate particles become easy to adhere to a metal material surface at a comparatively uniform density, thereby forming a superior chemical conversion coating film in the chemical conversion treatment.

Moreover, since the (1) metal alkoxide tends to adhere to a metal material surface, it is speculated that an affinity between the metal phosphate particles and the metal material surface is also increased.

Furthermore, the (1) metal alkoxide can preferably suppress sedimentation even in tap water in which the metal phosphate particles easily precipitate. Though it is not clear why the sedimentation is preferably suppressed even in tap water, it is speculated that the (1) metal alkoxide traps metal polycations such as calcium ion or magnesium ions derived from the tap water, thereby suppressing the sedimentation due to reaggregation of metal phosphate compound particles.

As described above, it is possible to improve dispersion stability of metal phosphate particles in a concentrated dispersion liquid by using the (1) metal alkoxide in combination with a conventionally known (2) stabilizer.

By adding the (1) metal alkoxide, dispersibility of metal phosphate particles is improved, and it becomes easier to prepare metal phosphate particles with an average particle diameter of no more than 0.5 μm. Moreover, after forming a metal chemical conversion coating film, adhesion properties and anticorrosion are superior.

The metal alkoxide is not particularly limited as long as it is a compound having a M-OR bond, and examples thereof include, e.g., those represented by the following general formula (I):

$$R^1\text{-}M\text{-}(R^2)_n(OR^2)_{3-n} \quad (I)$$

in which M represents silicon, titanium or aluminum; $R^1$ represents an alkyl group having 1 to 6 carbon atoms and which is unsubstituted or substituted with an organic group, an epoxyalkyl group having 1 to 11 carbon atoms, an aryl group, an alkenyl group having 1 to 11 carbon atoms, an aminoalkyl group having 1 to 5 carbon atoms, a mercaptoalkyl group having 1 to 5 carbon atoms, or a halogenoalkyl group having 1 to 5 carbon atoms; $R^2$ represents an alkyl group having 1 to 6 carbon atoms; and n is 0, 1, or 2.

The metal alkoxide as described above is preferably an alkoxysilane compound having at least one mercapto group or (meth)acryloxy group.

[Alkoxysilane Compound]

The alkoxysilane compound is not particularly limited as long as it can be used in a water-based system, and examples thereof include, e.g., vinylmethyldimethoxysilane, vinyltrimethoxysilane, vinylethyldiethoxysilane, vinyltriethoxysilane, 3-aminopropyltriethoxysilane, 3-glycidoxypropyltrimethoxysilane, 3-(meth)acryloxypropyltrimethoxysilane, 3-mercaptopropyltrimethoxysilane, N-(1,3-dimethylbutylidene)-3-(triethoxysilyl)-1-propaneamine, N,N'-bis[3-(trimethoxysilyl)propyl]ethylenediamine, N-(β-aminoethyl)-g-aminopropylmethyldimethoxysilane, N-(β-aminoethyl)-3-aminopropyltrimethoxysilane, 3-aminopropyltrimethoxysilane, g-glycidoxypropyltrimethoxysilane, 3-glycidoxypropyltriethoxysilane, 3-glycidoxypropylmethyldimethoxysilane, 2-(3,4-epoxycyclohexyl)ethyltrimethoxysilane, 3-methacryloxypropyltriethoxysilane, 3-mercaptopropyltriethoxysilane, N-[2-(vinylbenzylamino)ethyl]-3-aminopropyltrimethoxysilane, and the like. These may be used alone, or two or more may be used in combination.

Among them, it is preferred that at least one mercapto group or (meth)acryloxy group be included in one molecule of the alkoxysilane. For example, 3-mercaptopropyltrimethoxysilane, 3-mercaptopropyltriiethoxysilane, 3-(meth) acryloxypropylmethyltrimethoxysilane, and 3-(meth)acryloxypropyltriethoxysilane are particularly preferred.

[Content of Metal Alkoxide]

The content of the aforementioned (1) metal alkoxide in the concentrated dispersion liquid preferably has a lower limit of 0.01 parts by weight and an upper limit of 1000 parts by weight per 100 parts by weight of the solid content of the phosphate particles. When the content is less than 0.01 parts by weight, the absorption on the metal phosphate particles becomes insufficient, and the dispersion acceleration effect and the effect of adhesion to the metal material are not obtained, which may lead to concern of whether the effect of surface conditioning is sufficiently achieved. Furthermore, a content of 1000 parts by weight or greater is not economical because an effect exceeding the desired effect cannot be achieved. With respect to the content, a lower limit of 0.1 parts by weight and an upper limit of 100 parts by weight are more preferred, and a lower limit of 0.5 parts by weight and an upper limit of 25 parts by weight are still more preferred. With respect to the content, a lower limit of 1 part by weight and an upper limit of 10 parts by weight are particularly preferred.

With respect to the content of the (1) metal alkoxide, it is preferred that the lower limit be 1 ppm, and the upper limit be 1000 ppm in the surface conditioning treatment bath. When the content is less than 1 ppm, the effect of acceleration of dispersion and adhesion of the metal alkoxide to the metal phosphate particles is not sufficient because the absorption on the particles becomes insufficient, which may lead to concern of whether the effect of surface conditioning is sufficiently achieved. A content of greater than 1000 ppm is not economical because an effect exceeding the desired effect cannot be nevertheless achieved. With respect to the content, a lower limit of 10 ppm and an upper limit of 500 ppm are more preferred, and a lower limit of 10 ppm and an upper limit of 200 ppm are still more preferred. A particularly preferable upper limit of the content is 100 ppm.

[Metal Phosphate Particles]

The surface conditioning composition of the present invention contains bivalent or trivalent metal phosphate particles. The aforementioned metal phosphate particles are to be the crystal nucleus for imparting the surface conditioning function. It is believed that the reaction for the chemical conversion treatment is accelerated by adhesion of these particles to the metal material surface.

The bivalent or trivalent metal phosphate particles are not particularly limited, and examples thereof include, e.g., particles of $Zn_3(PO_4)_2$, $Zn_2Fe(PO_4)_2$, $Zn_2Ni(PO_4)_2$, $Ni_3(PO_4)_2$, $Zn_2Mn(PO_4)_2$, $Mn_3(PO_4)_2$, $Mn_2Fe(PO_4)_2$, $Ca_3(PO_4)_2$, $Zn_2Ca(PO_4)_2$, $FePO_4$, $AlPO_4$, $COPO_4$, $CO_3(PO_4)_2$, and the like. Among them, zinc phosphate particles are preferred in light of a similarity to the crystals of the coating film in the phosphoric acid treatment, particularly to zinc phosphate treatment, of the chemical conversion treatment.

The $D_{50}$ of the aforementioned bivalent or trivalent metal phosphate particles is no more than 3 μm. By setting $D_{50}$ to fall within the above range, it is possible to form a dense chemical conversion coating film. When the metal phosphate particles becomes large, the dispersion stability of the metal phosphate particles in the treatment liquid for surface conditioning may be insufficient, and thus the metal phosphate particles may be likely to sediment.

On the other hand, since the surface conditioning composition of the present invention contains zinc phosphate particles with an average particle diameter represented by $D_{50}$ of no more than 3 μm, the dispersion stability in the treatment liquid for surface conditioning of metal phosphate particles is superior, and a dense chemical conversion coating film can be formed.

As for the $D_{50}$ of the metal phosphate particles, it is preferred that a lower limit be 0.01 μm. A lower limit of the $D_{50}$ of less than 0.01 μm is not economical because of inferior productivity of the chemical conversion coating film formed on the metal material surface. More preferably, the lower limit is 0.1 μm and the upper limit is 1 μm.

The $D_{90}$ of the metal phosphate particles is preferably no more than 4 μm. In this case, as for the metallic phosphate particles, in addition to $D_{50}$ being no greater than 3 μm, $D_{90}$ is no greater than 4 μm, and therefore the proportion of the coarse metal phosphate particles is comparatively small.

As described above, by using metal phosphate particles with the $D_{50}$ no greater than 3 μm, it is possible to form a sufficient amount of chemical conversion coating film on a metal material surface in brief chemical conversion treatment. However, when a means such as pulverizing is employed for providing a dispersion with a diameter of no greater than 3 μm, excessive pulverizing may cause reaggregation due to a relative lack of the dispersant as the specific surface area is increased. Hence, the dispersion stability may be deteriorated through forming large particles. Moreover, depending on the constituting ingredients and conditions of preparation of the surface conditioning composition, the particle diameter distribution of the aforementioned phosphate particles may be broadened, leading to the probability of causing problems of reaggregation of the minute particles, an increase in viscosity and the like. On the other hand, when the $D_{90}$ of the metal phosphate particles is no greater than 4 μm, the occurrence of the foregoing problems can be suppressed.

As for $D_{90}$ of the metal phosphate particles, it is preferred that the lower limit be 0.01 μm and the upper limit be 4 μm. When the $D_{90}$ is less than 0.01 μm, aggregation of the particles is likely to occur due to the phenomenon of excessive dispersion. When the $D_{90}$ is greater than 4 μm, the proportion of minute metal phosphate particles is decreased, and therefore is not adequate. The lower limit is more preferably 0.05 μm, and the upper limit is more preferably 2 μm.

The $D_{50}$ (the diameter of the particles corresponding to 50% in terms of the volume) and the $D_{90}$ (the diameter of the particles corresponding to 90% in terms of the volume) are the diameters of the particle at the points of 50%, and 90%, respectively, in a cumulative curve as determined assuming that the total volume of the particles is 100% on the basis of the particle diameter distribution in the dispersion liquid. The $D_{50}$ and $D_{90}$ can be measured by using an apparatus for measuring-particle grade such as an optical diffraction type particle size analyzer ("LA-500," trade name, manufactured by Horiba, Ltd.). Herein, the reference to "average particle diameter" indicates the $D_{50}$.

[Content of Metal Phosphate Particles]

In the treatment liquid for surface conditioning of the present invention, the content of the metal phosphate particles has preferably a lower limit of 50 ppm and an upper limit of 20000 ppm. When the content is less than 50 ppm, the metal phosphate to be the crystal nucleus may be deficient, and thus it is probable that the surface conditioning effect cannot be sufficiently achieved. A content of greater than 20000 ppm is not economical because an effect exceeding the desired effect can not be achieved. With respect to the content, a lower limit of 150 ppm and an upper limit of 10000 ppm are more preferred, and a lower limit of 250 ppm and an upper limit of 2500 ppm are still more preferred. With respect to the content, a lower limit of 500 ppm and an upper limit of 2000 ppm are particularly preferred.

[Stabilizer]

The aforementioned (2) stabilizer indicates a compound having an effect to improve dispersion stability of metal phosphate particles in a solvent. For such a compound, a well-known compound can be used, and examples thereof include phosphonic acid, phytic acid, polyphosphoric acid, a phosphonic acid group-containing acrylic resin and vinylic resin, a carboxyl group-containing acrylic resin and vinylic resin, saccharide, layered clay mineral, etc. From the viewpoint that acquisition is easy, phosphonic acid, phytic acid, and polyphosphoric acid are preferred. In addition, two of these compounds may be used in combination.

[Carboxyl Group-Containing Acrylic Resin and Vinylic Resin]

The carboxyl group-containing resin and vinylic resin are not particularly limited, and examples thereof include resins obtained by radical polymerization and the like of a monomer composition containing a carboxyl group-containing ethylenic unsaturated monomer such as (meth)acrylic acid, maleic acid or fumaric acid, and the like.

[Phosphonic Acid Group-Containing Acrylic Resin and Vinylic Resin]

The phosphonic acid group-containing resin and vinylic resin are not particularly limited, and examples thereof include resins obtained by polymerization of a monomer composition containing a phosphon group-containing ethylenic monomer such as 3-(meth)acryloxy propyl phosphonic acid.

[Saccharide]

The aforementioned saccharide is not particularly limited, and examples thereof include polysaccharides, polysaccharide derivatives, and alkali metal salts such as sodium salts and potassium salts thereof, and the like.

Examples of the polysaccharide include cellulose, methyl cellulose, ethyl cellulose, methylethyl cellulose, hemicellulose, starch, methyl starch, ethyl starch, methylethyl starch, agar, carrageen, alginic acid, pectic acid, guar gum, tamarind seed gum, locust bean gum, konjac mannan, dextran, xanthan gum, pullulan, gellan gum, chitin, chitosan, chondroitin sulfate, heparin, hyaluronic acid, and the like.

Examples of the polysaccharide derivative include carboxyalkylated or hydroxyalkylated polysaccharides described above such as carboxymethyl cellulose (CMC) and hydroxyethyl cellulose, starch glycolic acid, agar derivatives, carrageen derivatives, and the like.

[Layered Clay Mineral]

The layered clay mineral is not particularly limited, and examples thereof include layered polysilicic acid salts, e.g., smectites such as montmorillonite, beidellite, saponite, and hectorite; kaolinites such as kaolinite, and halloysite; vermiculites such as dioctahedral vermiculite, and trioctahedral vermiculite; micas such as teniolite, tetrasilicic mica, muscovite, illite, sericite, phlogopite, and biotite; hydrotalcite; pyrophilolite; kanemite, makatite, ilerite, magadiite, and kenyaite, and the like.

These layered clay minerals may be either a naturally occurring mineral, or a synthetic mineral yielded by hydrothermal synthesis, a melt process, a solid phase process or the like. Above all, smectites are preferable, and natural hectorites and/or synthetic hectorites are more preferable. Accordingly, more superior dispersion stability can be imparted to the concentrated liquid, and also the production efficiency and quality of the concentrated liquid can be enhanced.

It is speculated as follows. The aforementioned (2) stabilizer tends to be negatively charged in solution. When the stabilizer is absorbed in the surface of the metal phosphate particles, the metal phosphate particles repel one another. As a result, the particles adhere on the metal material surface at uniform density as crystal nuclei, thereby making it easier to form a sufficient amount of chemical conversion coating film on the metal material surface in the chemical conversion treatment.

The aforementioned (2) stabilizer suppresses not only sedimentation of phosphate particles in the surface conditioning composition, but also sedimentation of phosphate particles in the concentrated dispersion liquid, thereby making it possible to maintain long-term storage stability of the concentrated dispersion liquid.

[Content of Stabilizer]

The content of the aforementioned (2) stabilizer in the concentrated dispersion liquid has preferably a lower limit of 0.01 parts by weight and an upper limit of 1000 parts per 100 parts by weight of the solid content of the metal phosphate particles. When the content is less than 0.01 parts by weight, the sedimentation-preventing effect may not be sufficiently achieved. Furthermore, a content of 1000 parts by weight or greater is not economical because an effect exceeding the desired effect cannot be achieved. With respect to the concentration, a lower limit of 0.1 parts by weight and an upper limit of 100 parts by weight are more preferred, and a lower limit of 0.5 parts by weight and an upper limit of 25 parts by weight are still more preferred. With respect to the concentration, a lower limit of 1 part by weight and an upper limit of 10 parts by weight are particularly preferred.

With respect to the content of the (2) stabilizer, it is preferred that a lower limit be 1 ppm, and an upper limit be 1000 ppm in the treatment liquid for surface conditioning. When the content is less than 1 ppm, an effect of preventing sedimentation may not be sufficiently achieved. A content of greater than 1000 ppm is not economical because an effect exceeding the desired effect cannot be nevertheless achieved. With respect to the concentration, a lower limit of 10 ppm and an upper limit of 500 ppm are more preferred. A more preferable upper limit of the concentration is 200 ppm, and a particularly preferable upper limit is 100 ppm. It should be noted that two or more kinds of the aforementioned (2) stabilizer may be used in combination.

[Chelating Agent and/or Surfactant]

The surface conditioning composition of the present invention may further include a chelating agent and/or a surfactant. By including the chelating agent, more superior dispersion stability to hardening components can be imparted. More specifically, even in the case in which the surface conditioning composition of the present invention is contaminated with a magnesium ion or a calcium ion included in tap water, reaggregation of the metal phosphate particles does not occur, and thus it is easy to maintain the stability in the treatment liquid for surface conditioning. Moreover, it is economically preferable because tap water can be used.

[Chelating Agent]

The chelating agent is not particularly limited as long as the chelating agent can chelate with hardening components such as calcium ions and magnesium ions, and examples thereof include citric acid, tartaric acid, pyrophosphate, tripolyphosphate Na, EDTA, gluconic acid, succinic acid and malic acid, and compounds and derivative thereof.

[Content of Chelating Agent]

The content of the chelating agent in the treatment liquid for surface conditioning is preferably between a lower limit of 1 ppm and an upper limit of 10000 ppm. When the content is less than 1 ppm, the hard components cannot be sufficiently chelated, and thus the reaggregation of the metal phosphate particles may not be suppressed. Even if the content is greater than 10000 ppm, an effect exceeding the desired effect cannot be achieved, and it is probable that the active ingredient in the treatment liquid for surface conditioning may be chelated to thereby inhibit the surface conditioning reaction. With respect to the content, a lower limit of 10 ppm and an upper limit of 1000 ppm are more preferred. A more preferable upper limit of the content is 200 ppm.

[Surfactant]

The aforementioned surfactant is more preferably an anionic surfactant or a nonionic surfactant.

The anionic surfactant or the nonionic surfactant is contained in the surface conditioning composition of the present invention. Accordingly, it is possible to form a sufficient amount of chemical conversion coating film at the aluminum-based metal material portion where the iron- or zinc-based metal materials and the aluminum-based metal materials contact with each other. This makes it possible to reduce the difference in the amount of the chemical conversion coating films of the general portion and the electrolytic corrosion portion.

Moreover, it is possible to form a dense chemical conversion coating film on various metal materials. Furthermore, it is possible to form a sufficient amount of chemical conversion coating film even on conversion resistant metal materials such as the aluminum-based metal materials and the high-tensile steel sheet.

The nonionic surfactant is not particularly limited, and examples thereof include, e.g., polyoxyethylene alkyl ether, polyoxyalkylene alkyl ether, polyoxyethylene derivatives, oxyethylene-oxypropylene block copolymers, sorbitan fatty acid esters, polyoxyethylene sorbitan fatty acid esters, polyoxyethylene sorbitol fatty acid esters, glycerine fatty acid esters, polyoxyethylene fatty acid esters, polyoxyethylene alkylamine, alkylalkanode amide, nonylphenol, alkylnonylphenol, polyoxyalkylene glycol, alkylamine oxide, acetylenediol, polyoxyethylene nonylphenyl ether, silicon based surfactants such as polyoxyethylene alkylphenyl ether-modified silicon, nonionic surfactants which are selected from fluorine-based surfactants prepared through substitution of at least one hydrogen atom in a hydrophobic group of a hydrocarbon-based surfactant with a fluorine atom and which have hydrophilic lipophilic balance (HLB) of 6 or greater. Among them, polyoxyethylene alkyl ether and polyoxyalkylene alkyl ether having HLB of 6 or greater are preferred in light of obtaining further improved effects of the present invention.

The anionic surfactant is not particularly limited, and examples thereof include, e.g., fatty acid salts, alkylsulfuric acid ester salts, alkyl ether sulfuric acid ester salts, alkylbenzene sulfonate, alkylnaphthalene sulfonate, alkylsulfosuccinate, alkyldiphenyl ether disulfonate, polybisphenol sulfonate, alkylphosphate, polyoxyethylalkyl sulfuric acid ester salts, polyoxyethylalkylallylsulfuric acid ester salts, alpha-olefin sulfonate, methyl taurine acid salts, polyaspartate, ether carboxylate, naphthalene sulfonic acid-formalin condensates, polyoxyethylene alkylphosphate esters, alkyl ether phosphoric acid ester salts, and the like. Among them, alkyl ether phosphoric acid ester salts are preferred in light of obtaining further improved effects of the present invention.

The anionic surfactants can be used after neutralization with ammonia or amine based neutralizing agent. Examples of the amine based neutralizing agent include, e.g., diethylamine (DEA), triethylamine (TEA), monoethanolamine (META), diethanolamine (DETA), triethanolamine (TETA), dimethylethanolamine (DMEA), diethylethanolamine (DEEA), isopropylethanolamine (IPEA), diisopropanolamine (DIPA), 2-amino-2-methylpropanol (AMP), 2-(dimethylamino)-2-methylpropanol (DMAMP), morpholine (MOR), N-methylmorpholine (NMM), N-ethylmorpholine (NEM), and the like. Among them, 2-amino-2-methylpropanol (AMP) is preferably used.

[Content of Surfactant]

With respect to the content of the surfactant in the treatment liquid for surface conditioning, a lower limit of 3 ppm and an upper limit of 500 ppm are preferred. When the content falls within the above range, the effect of the present invention can be favorably achieved. With respect to the content, a lower limit of 5 ppm and an upper limit of 300 ppm are more preferred.

The surfactant may be used alone, or two or more thereof may be used in combination.

[Metal Nitrite Compound]

A bivalent or trivalent metal nitrite compound can be added to the surface conditioning composition as needed to still further suppress the generation of rust.

[Dispersion Medium]

The surface conditioning composition can contain a dispersion medium for allowing the aforementioned bivalent or trivalent metal phosphate particles to be dispersed.

Examples of a dispersion medium which may be used include aqueous media including 80% by weight or more of water, as well as media other than water such as various water soluble organic solvents. However, it is desired that the content of the organic solvent be as low as possible, which may be preferably 10% by weight or less, more preferably 5% by weight or less of the aqueous medium. A dispersion medium including water alone is also acceptable.

The water soluble organic solvent is not particularly limited, and examples thereof include, e.g., alcoholic solvents such as methanol, ethanol, isopropanol and ethyleneglycol; ether based solvents such as ethyleneglycol monopropyl ether, butylglycol and 1-methoxy-2-propanol; ketone based solvents such as acetone and diacetone alcohol; amide based solvents such as dimethylacetamide and methylpyrrolidone; ester based solvents such as ethylcarbitol acetate, and the like. These may be used alone, or two or more may be used in combination.

[Alkali Salt]

To the surface conditioning composition, an alkali salt such as soda ash may be added for the purpose of further stabilizing the bivalent or trivalent metal phosphate particles to form a minute chemical conversion coating film in the chemical conversion treatment step subsequently carried out.

[pH]

With regard to the aforementioned surface conditioning composition, a lower limit of the pH is 3, and an upper limit is 12. When the pH is less than 3, the bivalent or trivalent metal phosphate particles become likely to be readily dissolved and unstable, which may affect the subsequent step. When the pH is greater than 12, the pH of the chemical conversion treatment bath in the subsequent step may increase, which may lead to defective chemical conversion. The lower limit is further preferably 6, while the upper limit is further preferably 11.

[Method for Producing Metal Surface Conditioning Composition]

The surface conditioning composition of the present invention can be produced, for example, by the following method. When zinc phosphate is used as the bivalent or trivalent metal phosphate, zinc phosphate particles can be obtained, for example, by using zinc phosphate as a raw material. The zinc phosphate of the raw material is represented as $Zn_3(PO_4)_2.4H_2O$, is generally a crystalline solid with no color, and is commercially available as a white powder.

As a method for producing the zinc phosphate of the raw material, for example, diluted liquids of zinc sulfate and disodium hydrogenphosphate are mixed at a molar ratio of 3:2 followed by heating, and tetrahydrate of the zinc phosphate is generated as crystalline precipitates. Moreover, tetrahydrate of the zinc phosphate can also be obtained by reacting a diluted phosphoric acid aqueous solution and zinc oxide or zinc carbonate. The crystal of the tetrahydrate is an orthorhombic system, and has three kinds of confirmations. When heated, it becomes a dihydrate at 100 degrees Celsius, monohydrate at 190 degrees Celsius, and nonhydrate at 250 degrees Celsius. As the zinc phosphate in the present invention, any of the tetrahydrate, dihydrate, monohydrate and nonhydrate is available, but use of the tetrahydrate suffices as it is, which is generally easy to obtain.

The form of the bivalent or trivalent metal phosphate of the raw material is not particularly limited, but one having any arbitrary form can be used. Although commercially available products are generally in the state of a white powder, the form of the powder may be any one such as fine particulate, platy, squamous, or the like. Furthermore, the particle diameter of the bivalent or trivalent metal phosphate is not particularly limited, but in general, powders exhibiting an average particle diameter of approximately several micrometers (μm) may be used. Particularly, commercially available products as rust preventive pigments may be suitably used such as products having an improved buffering action by subjecting to a treatment for imparting basicity.

According to the present invention as described later, a stable dispersion liquid of the finely and uniformly dispersed bivalent or trivalent metal phosphate can be prepared irrespective of the primary particle diameter and shape as the raw material bivalent or trivalent metal phosphate.

It is preferred that the bivalent or trivalent metal phosphate particles be used in a state of being finely dispersed. The method for preparing the concentrated dispersion liquid is not limited, but it is preferably achieved by mixing the bivalent or trivalent metal phosphate particles of the raw material in the aforementioned dispersion medium such as water or a water-soluble organic solvent, and performing wet pulverization in the presence of the aforementioned (1) metal alkoxide and the (2) stabilizer. Moreover, the aforementioned (1) metal alkoxide may be added as necessary after preparing the concentrated dispersion liquid.

It should be noted that, in order to obtain the concentrated dispersion liquid of the bivalent or trivalent metal phosphate particles, it is convenient in terms of steps to compound the bivalent or trivalent metal phosphate of the raw material into the aqueous medium for wet pulverization at the time of preparing the concentrated dispersion liquid; however, the concentrated dispersion liquid may also be prepared by solvent replacement after performing wet pulverization in a dispersion medium other than the aqueous medium.

In the preparation of the concentrated dispersion liquid, the amount of the bivalent or trivalent metal phosphate of the raw material in the concentrated dispersion liquid is preferably, in general, between a lower limit of 0.5% by mass and an upper limit of 50% by mass with respect to the mass of concentrated dispersion liquid. When the amount is less than 0.5% by mass, the surface conditioning effect may not be sufficiently achieved in the treatment liquid for surface conditioning that is obtained by using the concentrated dispersion liquid, because the content of the bivalent or trivalent metal phosphate is too low. When the amount is greater than 50% by mass, it becomes difficult to obtain uniform and minute particle diameter distribution by wet pulverization, and to achieve fine dispersion. With respect to the content, a lower limit of 1% by mass and an upper limit of 40% by mass are more preferred, and a lower limit of 10% by mass and an upper limit of 30% by mass are particularly preferred.

With respect to the amount of addition of the aforementioned (1) metal alkoxide and (2) stabilizer in the concentrated dispersion liquid, a lower limit of 0.1% by mass and an upper limit of 50% by mass are preferred. When the amount is less than 0.1% by mass, the dispersion may not be satisfactory. When the amount is greater than 50% by mass, dispersibility may be deteriorated due to the influence of the aforementioned (1) metal alkoxide and/or the aforementioned (2) stabilizer being excessive, and it is not economical even if the dispersion is satisfactory. The lower limit is more preferably 0.5% by mass, while the upper limit is more preferably 20% by mass. A particularly preferable lower limit is 1% by mass, while a particularly preferable upper limit is 10% by mass.

The method for obtaining the concentrated dispersion liquid, in which the bivalent or trivalent metal phosphate particles are finely dispersed with the $D_{50}$ being no more than 3 μm, is not limited, but preferably, 0.5 to 50% by mass of the bivalent or trivalent metal phosphate of the raw material, and 0.1 to 50% by mass of the aforementioned (1) metal alkoxide and (2) stabilizer are made to be present in a dispersion medium, and wet pulverization is performed. The method of wet pulverization is not particularly limited, and a means of general wet pulverization may be used; for example, any one of beads mills typified by the disc type, pin type and the like, high-pressure homogenizers, medialess dispersion machines typified by ultrasonic dispersion machines can be used.

In the wet pulverization, by monitoring the $D_{90}$ of the bivalent or trivalent metal phosphate particles, excessive dispersion can be prevented, and the aggregation as well as thickening or reaggregation of minute particles can be suppressed. In the present invention, it is preferable to set the $D_{90}$ at no more than 4 μm. In addition, it is desirable to select compounding and dispersion conditions which do not cause excessive dispersion.

By the aforementioned method for producing the concentrated dispersion liquid, the $D_{50}$ of the bivalent or trivalent metal phosphate can be regulated in the range of no more than 3 μm in the aqueous medium. Accordingly, it is possible to obtain a concentrated dispersion liquid which is superior in stability and which has superior performance as a surface conditioning composition. The $D_{50}$ can be regulated to a desired average particle diameter in a range of a lower limit of 0.01 μm to an upper limit of 3 μm.

By preparing a concentrated dispersion liquid by the aforementioned methods for preparing the concentrated dispersion liquid, even bivalent or trivalent metal phosphate of more than 3 μm can be dispersed in the aqueous medium in a state where the $D_{50}$ is no more than 3 μm. The above applies even to the bivalent or trivalent metal phosphate having a primary particle size of dozens of μm. This is because the primary particle diameter of the bivalent or trivalent metal phosphate particles can be decreased by conducting wet pulverization according to the process as described above, without using bivalent or trivalent metal phosphate originally having a small primary particle diameter. According to the aforementioned method, the $D_{50}$ of the bivalent or trivalent metal phosphate particles in the aqueous dispersion liquid can be 3 μm or less, or further, 1 μm or less, or still further, 0.2 μm or less.

In the concentrated dispersion liquid obtained as described above, the $D_{50}$ of the bivalent or trivalent metal phosphate particles in the surface conditioning composition can be regulated in the range of 3 μm or less to meet the intended use. Accordingly, this is a concentrated dispersion liquid that is superior in dispersion stability.

Since the proportion of the large particles represented as particles of a particle diameter of greater than the $D_{90}$ can be reduced by the wet pulverization method described above, it is possible to produce a concentrated dispersion liquid which has a sharp distribution of dispersion diameters, in which particles with a large dispersion diameter are suppressed, and in which the $D_{90}$ is particularly no more than 4 μm, or further, 2.6 μm or less, or still further, 0.3 μm or less. Accordingly, it is speculated that the bivalent or trivalent metal phosphate particles are dispersed with fine dispersion diameters, and that the dispersion state is extremely stable.

Moreover, since the proportion of large particles is low, it is speculated that the bivalent or trivalent metal phosphate in the treatment liquid for surface conditioning efficiently contributes to the generation of crystal nuclei. Since the distribution of dispersion diameters is sharp, and the particle diameters are comparatively uniform, it is speculated that crystal nuclei with more uniform particle diameters are formed in the surface conditioning treatment step, and a more uniform phosphate crystal film is formed by the subsequent chemical conversion treatment, thereby resulting in a uniform and superior surface property of the obtained chemical conversion treatment steel sheet. Furthermore, it is speculated that this improves treatment performances on metal materials and bag-shaped parts with a complex structure as well as on the conversion resistant metal sheets such as black steel sheets.

It should be noted that the $D_{50}$ and $D_{90}$ of the bivalent or trivalent metal phosphate in the concentrated dispersion liquid can be determined by the measurement of the particle diameter distribution using an optical diffraction type particle size analyzer as described above.

As for the aforementioned concentration dispersion liquid, a concentration dispersion liquid with high concentration can also be obtained in which the bivalent or trivalent metal phosphate is blended in an amount of at least 10% by mass, further, at least 20% by mass, and still further, at least 30% by mass.

This makes it possible to prepare a surface conditioning composition that has superior performance.

Other components (a bivalent or trivalent metal nitrite compound, a dispersion medium, a thickening agent, and the like) can also be admixed as needed into the concentrated dispersion liquid obtained as described in the foregoing. The method of mixing the concentrated dispersion liquid with the other component is not particularly limited but, for example, the other component may be added to and mixed with the concentrated dispersion liquid, or the other component may be blended during preparation of the concentrated dispersion liquid.

The treatment liquid for surface conditioning is prepared by, for example, diluting the aforementioned concentrated dispersion liquid with water. The aforementioned (1) metal alkoxide is preferably added to an aqueous medium at the same time of adding the bivalent or trivalent metal phosphate as needed, or may be added later to the concentrated dispersion liquid in which the bivalent or trivalent metal phosphate has been dispersed. The treatment liquid for surface conditioning is superior in dispersion stability, and favorable surface conditioning can thereby be done to the metal material.

[Method for Surface Conditioning]

The surface conditioning method of the present invention includes the step of bringing the aforementioned treatment liquid for surface conditioning into contact with a metal material surface. Hence, a sufficient amount of bivalent or trivalent metal phosphate fine particles can adhere to not only the iron- and zinc-based metal materials, but also to conversion resistant metal materials such as aluminum-based metal materials and high-tensile steel sheets, and a favorable chemical conversion coating film can be formed in the chemical conversion treatment step.

Moreover, multiple metal materials having a contact part of different kinds of metals such as, for example, an iron or zinc-based metal material and an aluminum-based metal material can be concurrently treated, and thus a sufficient amount of chemical conversion coating film can be formed on the metal material surface in the chemical conversion treatment step.

The process for bringing the treatment liquid for surface conditioning into contact with the metal material surface in the above method for surface conditioning is not particularly limited, but a conventionally known method such as dipping or spraying can be freely employed.

The metal material to be subjected to the surface conditioning is not particularly limited, and the process is applicable to a variety of metals generally subjected to the phosphate chemical conversion treatment, such as, for example, galvanized steel plates, aluminum or aluminum alloys, magnesium alloys, or iron-based metal materials such as cold-rolled steel plates and high-tensile steel plates.

Moreover, it is suitably applicable to usage in which multiple kinds of metal materials such as, for example, an iron steel or galvanized steel sheet and aluminum or an aluminum alloy are simultaneously subjected to the treatment.

Moreover, using the surface conditioning composition of the present invention, a step of surface conditioning in combination with degreasing can be carried out. Accordingly, the step for washing with water following a degreasing treatment can be omitted. In the aforementioned step of surface conditioning in combination with degreasing, a known inorganic alkali builder, an organic builder or the like may be added for the purpose of increasing the detergency. In addition, a known condensed phosphate or the like may be added.

In the surface conditioning as described above, the contact time of the treatment liquid for surface conditioning with the metal material surface, and the temperature of the treatment liquid for surface conditioning are not particularly limited, but the process can be performed under conventionally known conditions.

After performing the surface conditioning, the chemical conversion treatment is carried out to enable production of a chemical conversion treated metal plate. The process for the chemical conversion treatment is not particularly limited, but any one of various known processes such as a dipping treatment, a spraying treatment, or an electrolytic treatment can be employed. Multiple kinds of these treatments may be conducted in combination.

Furthermore, with regard to the chemical conversion coating film to be formed on a metal material surface, it is not particularly limited as long as it is a metal phosphate, and examples thereof include zinc phosphate, iron phosphate, manganese phosphate, zinc-calcium phosphate and the like, but are not limited thereto. Among them, zinc phosphate is preferred.

In the chemical conversion treatment, the contact time of the chemical conversion treatment agent with the metal material, and the temperature of the chemical conversion treatment agent are not particularly limited, and the treatment can be performed under conventionally known conditions.

After carrying out the aforementioned surface conditioning and the aforementioned chemical conversion treatment, a coated steel sheet can be produced by further carrying out coating. The coating process is generally electrodeposition coating. The paint for use in the coating is not particularly limited, but may be of various types generally used in coating of a chemical conversion treated metal plate, and examples thereof include, e.g., epoxymelamine paints, as well as paints for cation electrodeposition, polyester-based intermediate coating paint and polyester-based top coating paints, and the like. A known process may be employed in which after the chemical conversion treatment, a washing step is carried out prior to the coating.

The surface conditioning composition of the present invention has pH of 3 to 12, and contains the (1) metal alkoxide, the bivalent or trivalent metal phosphate particles with the $D_{50}$ of no more than 3 μm, and the (2) stabilizer. Accordingly, in cases where surface conditioning is performed, with the surface treatment composition, on metal materials having a portion where an iron- or zinc-based metal material and an aluminum-based metal material contact with each other, and subsequently the chemical conversion treatment is performed, a sufficient amount of chemical conversion coating film can be formed on the aluminum-based metal material of the contacting portion. Furthermore, a sufficient amount of chemical conversion coating film can be formed even in cases where it is applied to conversion resistant metal materials such as an aluminum alloy and high-tensile steel sheets.

Moreover, the use of a particular component makes it possible to facilitate the formation of a chemical conversion coating film, and to form a dense chemical conversion coating film. Furthermore, since the bivalent or trivalent metal phosphate particles with the $D_{50}$ of no more than 3 μm are contained, the dispersion stability in the treatment liquid for surface conditioning is superior. Therefore, the surface conditioning composition can be preferably used for surface conditioning of various metal materials.

EFFECTS OF THE INVENTION

Since the surface conditioning composition of the present invention is constituted as described above, in cases where the composition is applied to metal materials such as iron, zinc and aluminum, and particularly in cases where the composition is applied to conversion resistant metal materials such as aluminum-based metal materials or high-tensile steel sheets, it is possible to form a sufficient amount of chemical conversion coating film, and the dispersion stability in the treatment liquid for surface conditioning is superior, thereby making it possible to suppress electrolytic corrosion on the metal materials during the chemical conversion treatment.

The surface conditioning composition can be preferably used for various metal materials, particularly metal materials having a portion where iron- or zinc-based metal materials and aluminum-based metal materials contact with each other.

PREFERRED MODE FOR CARRYING OUT THE INVENTION

Figure 1:
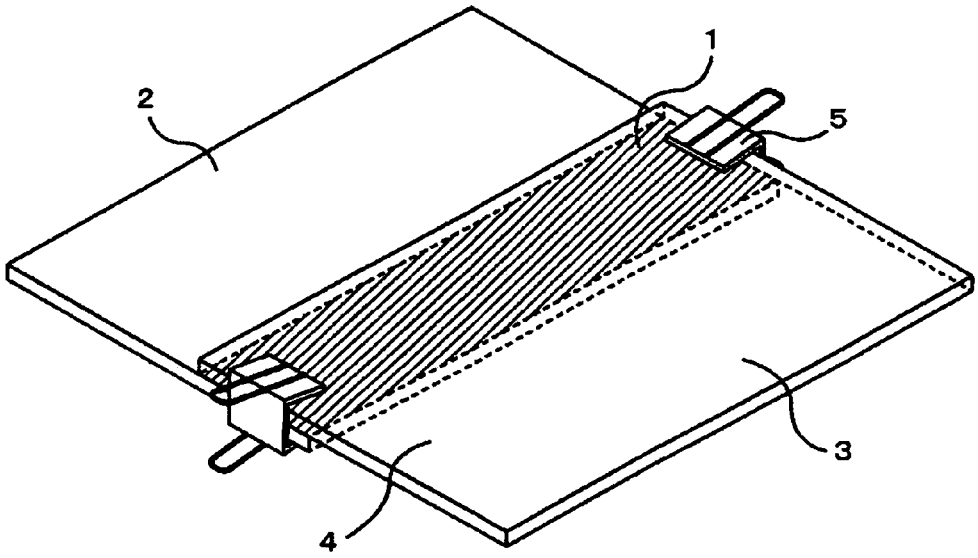
FIG. 1 shows a schematic drawing of an electrolytic corrosion aluminum test sheet used in the Examples.

The present invention is explained in more detail below by way of Examples, but the present invention is not limited only to these Examples. In the Examples, "part" or "%" each represents "part by mass" or "% by mass," respectively, unless otherwise specified. Moreover, in the surface conditioning treatment, the treatment liquid actually brought into contact with the metal material is referred to as "treatment liquid for surface conditioning," while the dispersion liquid of the metal phosphate particles for use in producing the treatment liquid for surface conditioning through dilution is referred to as "concentrated dispersion liquid". The treatment liquid for surface conditioning is obtained by diluting the concentrated dispersion liquid with a solvent such as water to give a predetermined concentration, and adding the necessary additives followed by adjusting the pH.

It should be noted that the $D_{50}$ (the method for measurement thereof is as follows) of zinc phosphate particles in the surface conditioning composition of Examples 1 to 4 and Comparative Examples 1 to 6, to be described below, is shown in Table 1. As a silane coupling agent, γ-mercapto propyl trimethoxysilane ("KBM803, trade name, manufactured by Shin-Etsu Chemical Co., Ltd.), and γ-(methacryloxy propyl)trimethoxysilane ("KBM503", trade name, manufactured by Shin-Etsu Chemical Co., Ltd.) were used. As the (2) stabilizer, carboxymethylcellulose ("APP84", trade name, manufactured by Nippon Paper Inc.) was used.

EXAMPLE 1

Preparation of Surface Conditioning Composition

To 60 parts by mass of pure water were added 1 part by mass of "KBM803," 1 part by mass of polyphosphoric acid ("SN2060," trade name, manufactured by San Nopco Limited) based on the solid content, and 20 parts by mass of zinc phosphate particles. To the mixture was added water to make 100 parts by mass. Dispersion was performed with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

EXAMPLES 2 AND 3

Preparation of Surface Conditioning Composition

A treatment liquid for surface conditioning was prepared similarly to Example 1, except that the kinds of the alkoxysilane and stabilizer were changed as shown in Table 1.

EXAMPLE 4

Preparation of Surface Conditioning Composition

To 60 parts by mass of pure water were added 1 part by mass of "KBM803," and 20 parts by mass of the zinc phosphate particles. Dispersion was performed with the SG mill for 180 min at a filling ratio of zirconia beads (1 mm) of 80%. To the resultant was added 1 part by mass of polyphosphoric acid ("SN2060," trade name, manufactured by San Nopco Limited) based on the solid content. To the mixture was added water to fill up to 100 parts by mass. The resulting concentrated dispersion liquid was diluted with tap water to give a zinc phosphate concentration of 0.1%, and the treatment liquid for surface conditioning was obtained through adjusting the pH to be 9 with NaOH.

COMPARATIVE EXAMPLE 1

Preparation of Surface Conditioning Composition

To 60 parts by mass of pure water were added 1 part by mass of "KBM803" and 30 parts by mass of zinc phosphate particles, and a dispersion was performed with the SG mill for 180 min at a filling rate of zirconia beads (1 mm) of 80%. To the mixture was added water to fill up to 100 parts by mass, thereby obtaining a concentrated dispersion liquid. The resulting concentrated dispersion liquid was diluted with tap water to give a zinc phosphate concentration of 0.1%, and the treatment liquid for surface conditioning was obtained through adjusting the pH to be 9 with NaOH.

COMPARATIVE EXAMPLE 2

Preparation of Surface Conditioning Composition

To 60 parts by mass of water were added 1 part by mass of polyacrylic acid ("SN44C," trade name, manufactured by San Nopco Limited) based on the solid content, and 20 parts by mass of zinc phosphate particles. Dispersion was performed with the SG mill for 180 min at a filling rate of zirconia beads (1 mm) of 80%. To the mixture was added water to fill up to 100 parts by mass, thereby obtaining a concentrated dispersion liquid. The resulting concentrated dispersion liquid was diluted with tap water to give a zinc phosphate concentration of 0.1%, and the treatment liquid for surface conditioning was obtained through adjusting the pH to be 9 with NaOH.

COMPARATIVE EXAMPLES 3 AND 4

Preparation of Surface Conditioning Composition

A treatment liquid for surface conditioning was prepared similarly to Comparative Example 1, except that the kind of the stabilizer was changed as shown in Table 1.

COMPARATIVE EXAMPLE 5

Preparation of Surface Conditioning Composition

To 60 parts by mass of pure water were added 1 part by mass of "SN44C," 1 part by mass of colloidal silica ("ST-30," trade name, manufactured by Nissan Chemical Industries, Ltd.) based on the solid content, and 20 parts by mass of zinc phosphate particles. To the mixture was added water to make 100 parts by mass. Dispersion was performed with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

COMPARATIVE EXAMPLE 6

Preparation of Surface Conditioning Composition

A titanium-phosphate-based powder surface conditioning agent ("5N10," trade name, manufactured by Nippon Paint Co., Ltd.) was diluted with tap water to 0.1%, and the pH was adjusted to 9 with NaOH.

EXAMPLES 1 TO 4 AND COMPARATIVE EXAMPLES 1 TO 6

[Production of Test Sheet 1]

A cold-rolled steel sheet (SPC) (70 mm×150 mm×0.8 mm), an aluminum sheet (Al) (#6000 series, 70 mm×150 mm×0.8 mm), a galvanized steel sheet (GA) (70 mm×150 mm×0.8 mm), and a high-tensile steel sheet (70 mm×150 mm×1.0 mm) were, respectively, subjected to a degreasing treatment using a degreasing agent ("SURFCLEANER EC92", trade name, 2%, manufactured by Nippon Paint Co., Ltd.) at 40 degrees Celsius for 2 min. Then, using the treatment liquid for surface conditioning obtained in Examples and Comparative Examples, the surface conditioning treatment was carried out at room temperature for 30 sec.

Subsequently, each steel sheet was subjected to a chemical conversion treatment using a zinc phosphate treatment liquid ("SURFDINE SD6350", trade name, manufactured by NIPPON PAINT CO., LTD.) with a dipping method at 35 degrees Celsius for 120 sec, followed by washing with water, washing with pure water, and drying to obtain a test sheet.

[Production of Test Sheet 2]

Similarly to the aforementioned Production of Test Sheet 1, an aluminum sheet 3 and a galvanized steel sheet 2 subjected to the degreasing treatment were produced, and the aluminum sheet 3 and the galvanized steel sheet 2 following the degreasing treatment were joined using a clip 5 as shown in FIG. 1. Next, the joined steel sheets were subjected, similarly to Production of Test Sheet 1, to the surface conditioning treatment, a chemical conversion treatment, washing with water, washing with pure water, and drying to obtain the test sheet.

The compositions of the surface conditioning composition obtained as in the foregoing are shown in Table 1.

[Evaluation Test]

According to the following methods, the particle diameter and stability of the zinc phosphate particles of the resulting surface conditioning composition were determined, and various evaluations of the test sheets thus obtained were conducted. The results are shown in Table 2. With respect to the steel sheet produced in the "Production of Test Sheet 2", the evaluation was made on a part of the electrolytic corrosion 1 of the aluminum sheet 3. In Table 2, those produced in "Production of Test Sheet 1" are designated as "SPC," "GA," "Al," and "high-tensile steel sheet," while those produced in "Production of Test Sheet 2" are designated as "Al (part of electrolytic corrosion)".

[Determination of Particle Diameter of Zinc Phosphate Particles]

With respect to particle diameters of the zinc phosphate particles included in the surface conditioning composition obtained in the Examples or Comparative Examples, the particle diameter distribution was determined using an optical diffraction type particle size analyzer ("LA-500", trade name, manufactured by Horiba, Ltd.), and the $D_{50}$ (average particle diameter of dispersion) was monitored to determine the $D_{50}$.

[Appearance of Coating Film]

The appearance of the formed coating film was visually evaluated on the basis of the following standards. In addition, the presence or absence of the generation of rust after the drying was observed. In cases where rust was generated, it was designated as "partly rusted" or "rusted" depending on the degree of rusting.

A: uniformly and minutely covering the entire face

B: roughly covering the entire face

C: parts were not covered

D: no substantial chemical conversion coating film formed

In addition, the size of the crystals of the formed chemical conversion coating film was measured with an electron microscope.

[Amount of Chemical conversion Coating Film (C/W)]

The measurement of amounts of chemical conversion coating films of the SPC test sheet and the GA test sheet was determined with a fluorescent X-ray measurement apparatus ("XRF-1700," trade name, manufactured by Shimadzu Corporation).

When the metal materials that were comparatively superior in chemical conversion capability such as SPC and GA were used, the chemical conversion performance is considered to be higher as the crystal particle diameter is smaller and as the amount of coating film is smaller, because formation of crystals as dense as possible is desired. In contrast, in the cases of conversion resistant metal materials such as the aluminum metal materials and the high-tensile steel sheets, an increase in the amount of the crystal coating film is required because of low chemical conversion treatment performance. Consequently, it has been determined that when there is a higher amount of coating film, the chemical conversion performance is high.

[Corrosion Resistance]

The test sheets (SPC, high-tensile steel sheets) obtained in Production of Test Sheet 1 were subjected to electrodeposition coating by use of a solution for cation electrodeposition ("POWERNIX 110", trade name, manufactured by Nippon Paint Co., Ltd.) such that the dry film thickness became 20 μm. The test sheets were produced by washing with water, and thereafter baking by heating at 170 degrees Celsius for 20 min. After making two longitudinally parallel cuts so as to reach to the base material, they were subjected to a salt dip test (5% salt water, dipping for 480 hrs at 35 degrees Celsius). Thereafter, tape stripping of the cut portions was performed, and the stripped width was evaluated. The results are shown in Table 2.

TABLE 1

| | ZINC PHOSPHATE | | | ALKOXIDE | | STABILIZER | |
|---|---|---|---|---|---|---|---|
| | PARTICLE DIAMETER ($D_{50}$) | PARTICLE DIAMETER ($D_{90}$) | CONCENTRATION | KIND | AMOUNT | KIND | AMOUNT |
| EXAMPLE 1 | 0.43 | 0.70 | 1000 ppm | KBM803 | 50 ppm | POLYPHOSPHORIC ACID | 50 ppm |
| EXAMPLE 2 | 0.46 | 0.72 | 1000 ppm | KBM503 | 50 ppm | POLYACRYLIC ACID (SN44C) | 50 ppm |
| EXAMPLE 3 | 0.45 | 0.71 | 1000 ppm | KBM803 | 50 ppm | CMC (APP84) | 50 ppm |
| EXAMPLE 4 | 0.37 | 0.69 | 1000 ppm | KBM803 | 50 ppm | POLYPHOSPHORIC ACID TO BE ADDED LATER (SN2060) | 50 ppm |
| COMPARATIVE EXAMPLE 1 | 0.41 | 0.69 | 1000 ppm | KBM803 | 50 ppm | NONE | |
| COMPARATIVE EXAMPLE 2 | 0.52 | 0.83 | 1000 ppm | NONE | | POLYACRYLIC ACID (SN44C) | 50 ppm |
| COMPARATIVE EXAMPLE 3 | 0.51 | 0.81 | 1000 ppm | NONE | | CMC (APP84) | 50 ppm |
| COMPARATIVE EXAMPLE 4 | 0.53 | 0.82 | 1000 ppm | NONE | | POLYPHOSPHORIC ACID (SN2060) | 50 ppm |
| COMPARATIVE EXAMPLE 5 | 0.52 | 0.82 | 1000 ppm | NONE | | POLYACRYLIC ACID (SN44C)<br>COLLOIDAL SILICA (ST-30) | 50 ppm<br>50 ppm |
| COMPARATIVE EXAMPLE 6 | SURFACE CONDITIONING COMPOSITION 5N-10 (1000 ppm) | | | | | | |

TABLE 2

| | APPEARANCE OF COATING FILM | | | | APPEARANCE OF COATING FILM (CRYSTAL) μm | | |
|---|---|---|---|---|---|---|---|
| | SPC | GA | Al (ELECTROLYTIC CORROSION PART) | HIGH-TENSILE STEEL SHEET | SPC | GA | Al (ELECTROLYTIC CORROSION PART) |
| EXAMPLE 1 | A | A | A | A | ABOUT 1 | ABOUT 1 | 2~5 |
| EXAMPLE 2 | A | A | A | A | ABOUT 1 | ABOUT 1 | 2~5 |
| EXAMPLE 3 | A | A | A | A | ABOUT 1 | ABOUT 1 | 2~5 |
| EXAMPLE 4 | A | A | A | A | ABOUT 1 | ABOUT 1 | 2~5 |
| COMPARATIVE EXAMPLE 1 | D | D | D | D | — | — | — |
| COMPARATIVE EXAMPLE 2 | C | C | C | C: PARTLY RUSTED | — | — | — |
| COMPARATIVE EXAMPLE 3 | C | C | C | C: PARTLY RUSTED | 1~2 | 2 | 5~10 |
| COMPARATIVE EXAMPLE 4 | C | C | C | C: PARTLY RUSTED | 1~2 | 2 | 5~10 |
| COMPARATIVE EXAMPLE 5 | C | C | C | C: PARTLY RUSTED | — | — | — |
| COMPARATIVE EXAMPLE 6 | B | B | D | D: RUSTED | 2 | 4 | x |

| | APPEARANCE OF COATING FILM (CRYSTAL) μm | AMOUNT OF CONVERSION COATING FILM ($g/m^2$) | | CORROSION RESISTANCE | |
|---|---|---|---|---|---|
| | HIGH-TENSILE STEEL SHEET | SPC | GA | SPC | HIGH-TENSILE STEEL SHEET |
| EXAMPLE 1 | ABOUT 1 | 1.5 | 2.3 | 0 mm | 0 mm |
| EXAMPLE 2 | ABOUT 1 | 1.6 | 2.3 | 0 mm | 0.2 mm |
| EXAMPLE 3 | ABOUT 1 | 1.6 | 2.3 | 0 mm | 0 mm |
| EXAMPLE 4 | ABOUT 1 | 1.6 | 2.4 | 0 mm | 0 mm |
| COMPARATIVE EXAMPLE 1 | — | | | — | — |
| COMPARATIVE EXAMPLE 2 | — | 1.9 | 3.1 | 0.5 mm | 4.5 mm |
| COMPARATIVE EXAMPLE 3 | 2~5 | 1.9 | 3.1 | 0 mm | 4.2 mm |
| COMPARATIVE EXAMPLE 4 | 2~5 | 1.9 | 3.2 | 0.5 mm | 3.8 mm |
| COMPARATIVE EXAMPLE 5 | — | 2.0 | 3.2 | 1 mm | 5.0 mm |
| COMPARATIVE EXAMPLE 6 | — | 1.9 | 3.2 | 0 mm | 4.1 mm |

Referring to Table 2, in cases where the surface conditioning composition of the Examples were used, a sufficient amount of chemical conversion coating film was formed on all of the cold-rolled steel sheets, galvanized sheets, and high-tensile steel sheet, and furthermore, a sufficient amount of chemical conversion coating film was formed also on a portion of the aluminum sheet at the part of contact with different kinds of metals, i.e. the aluminum sheet and the galvanized sheet. In other words, even though multiple kinds of metal materials were simultaneously treated with the surface conditioning composition, it was possible to form a sufficient amount of chemical conversion coating film.

INDUSTRIAL APPLICABILITY

The surface conditioning composition of the present invention can be suitably used for a variety of metal materials which have been employed in automotive bodies, home electric appliances, and the like.

The invention claimed is:

1. A surface conditioning composition in the form of a liquid comprising bivalent or trivalent metal phosphate particles and having a pH of 3 to 12, wherein a $D_{50}$ of the bivalent or trivalent metal phosphate particles is no more than 3 μm, the surface conditioning composition additionally comprises (1) at least one metal alkoxide selected from the group consisting of silane alkoxide, titanium alkoxide, and aluminum alkoxide, and (2) at least one stabilizer selected from the group consisting of phosphonic acid, phytic acid, polyphosphoric acid, phosphonic acid group-containing acrylic resin and vinylic resin, carboxyl group-containing acrylic resin and vinylic resin, and the composition comprises 1 to 1000 ppm of the (1) metal alkoxide as a treatment liquid for surface conditioning.

2. The surface conditioning composition according to claim 1, wherein the bivalent or trivalent metal phosphate particles is zinc phosphate.

3. The surface conditioning composition according to claim 2, wherein the (1) metal alkoxide is an alkoxysilane compound having a mercapto group or (meth)acryloxy group.

4. The surface conditioning composition according to claim 1, wherein the (1) metal alkoxide is an alkoxysilane compound having a mercapto group or (meth)acryloxy group.

5. The surface conditioning composition according to claim 1, wherein the composition comprises 1 to 1000 ppm of the (2) stabilizer as a treatment liquid for surface conditioning.

6. The surface conditioning composition according to claim 1, in the form of a concentrated dispersion liquid.

7. The surface conditioning composition according to claim 1, wherein the metal alkoxide is adsorbed onto the metal phosphate.

8. The surface conditioning composition according to claim 7, wherein a hydroxyl group produced by hydrolysis of (1) the metal alkoxide is adsorbed onto the metal phosphate.

9. The surface conditioning composition according to claim 1, wherein the composition comprises 50 to 20,000 ppm of the metal phosphate in the treatment liquid, and 0.01 to 1000 ppm of the (2) stabilizer in the treatment liquid.

10. The surface conditioning composition according to claim 1, wherein (1) the metal alkoxide is silane alkoxide.

11. The surface conditioning composition according to claim 8 wherein the bivalent or trivalent metal phosphate particles are dispersed in the liquid and form crystal nuclei accelerating chemical conversion treatment and surface condition of a metal surface by adhering thereto.

12. A method for surface conditioning comprising a step of bringing the surface conditioning composition according to claim 1 in contact with a metal material.

13. A surface conditioning composition in the form of a liquid comprising bivalent or trivalent metal phosphate particles and having a pH of 3 to 12, wherein a $D_{50}$ of the bivalent or trivalent metal phosphate particles is no more than 3 μm, the surface conditioning composition additionally comprises (1) at least one metal alkoxide selected from the group consisting of silane alkoxide, titanium alkoxide, and aluminum alkoxide dispersed in the liquid, and (2) a stabilizer dissolved or dispersed in the liquid, and the composition comprises 1 to 1000 ppm of the (1) metal alkoxide as a treatment liquid for surface conditioning.

14. The surface conditioning composition according to claim 13 wherein the bivalent or trivalent metal phosphate particles are dispersed in the liquid and form crystal nuclei accelerating chemical conversion treatment and surface condition of a metal surface by adhering thereto.

15. The surface conditioning composition according to claim 13 comprising between 0.5% by mass and 50% by mass of the bivalent or trivalent metal phosphate particles.

16. The surface conditioning composition according to claim 15 comprising between 1% by mass and 40% by mass of the bivalent or trivalent metal phosphate particles.

17. The surface conditioning composition according to claim 16 comprising between 10% by mass and 30% by mass of the bivalent or trivalent metal phosphate particles.

* * * * *